US005413744A

United States Patent [19]

Brückner et al.

[11] Patent Number: 5,413,744

[45] Date of Patent: May 9, 1995

[54] PROCESS FOR INDUCTIVE HEATING OF CERAMIC SHAPED PARTS

[75] Inventors: Raimund Brückner, Engenhahn; Ullrich Hintzen, Taunusstein-Watzhahn; Ernst Lührsen, Bad Schwalbach; Hans Rothfuss, Taunusstein; Albert Ott, Waldems-Würstems, all of Germany

[73] Assignee: Didier-Werke AG, Wiesbaden, Germany

[21] Appl. No.: 135,581

[22] Filed: Oct. 13, 1993

Related U.S. Application Data

[63] Continuation of Ser. No. 924,935, Aug. 5, 1992, abandoned.

[30] Foreign Application Priority Data

Aug. 5, 1991 [DE] Germany ..... 41 25 916.5

[51] Int. Cl.[6] ..... B29C 35/02; C04B 35/64; C01B 31/00

[52] U.S. Cl. ..... 264/25; 264/29.1; 264/63; 264/DIG. 46; 222/590; 222/593; 425/174.8 R; 425/DIG. 13; 501/99

[58] Field of Search ..... 264/25, 26, 63, 104, 264/122, 125, 126, 105, 29.1, 60, DIG. 46; 501/99, 100, 103, 101; 222/590, 591, 593; 425/174.8 R, DIG. 13

[56] References Cited

U.S. PATENT DOCUMENTS

| | | | |
|---|---|---|---|
| 3,153,636 | 10/1964 | Shanta et al. | 264/29.1 |
| 3,250,832 | 5/1966 | Metz | 264/29.1 |
| 3,409,451 | 11/1968 | Zeitsch | 501/99 |
| 3,435,992 | 4/1969 | Tisdale et al. | 222/146 |
| 3,496,256 | 2/1970 | Boquist | 501/103 |
| 3,917,110 | 11/1975 | Kiguchi | 222/590 |
| 4,059,662 | 11/1977 | Murakami et al. | 501/99 |
| 4,359,625 | 11/1982 | Okada et al. | 222/590 |
| 4,913,408 | 4/1990 | Hoggard et al. | 501/99 |
| 4,993,607 | 2/1991 | Brun et al. | 222/590 |
| 5,052,597 | 10/1991 | Bruckner | 222/593 |
| 5,054,664 | 10/1991 | Bruckner | 222/591 |

FOREIGN PATENT DOCUMENTS

| | | | |
|---|---|---|---|
| 2844686 | 4/1980 | Germany | 222/590 |
| 55-10374 | 1/1980 | Japan | 222/590 |
| 3-94967 | 4/1991 | Japan | 222/590 |
| 1581058 | 12/1980 | United Kingdom | 222/590 |

*Primary Examiner*—Mathieu D. Vargot
*Attorney, Agent, or Firm*—Wenderoth, Lind & Ponack

[57] ABSTRACT

A process for heating a ceramic shaped part by providing a ceramic shaped part which at ambient temperature has a homogeneously distributed carbon skeleton, and heating the shaped part inductively.

14 Claims, No Drawings

PROCESS FOR INDUCTIVE HEATING OF CERAMIC SHAPED PARTS

This application is a continuation of now abandoned application Ser. No. 07/924,935, filed Aug. 5, 1992, now abandoned.

BACKGROUND OF THE INVENTION

The present invention relates to a process for heating ceramic shaped parts, where the shaped parts are heated inductively to the desired temperature.

A discharge sleeve for the continuous casting of liquid metal or conventional steel is already known from U.S. Pat. No. 3,435,992, where the discharge sleeve is heated inductively prior to bringing it into contact with the liquid metal. The discharge sleeve described in this U.S. patent exhibits an electrically conductive insert in a discharge sleeve molded from a refractory material that is substantially not electrically conductive. The electrically conductive insert, which is made preferably from one graphite piece, can be heated with a current of suitable frequency ranging from 3 to 50 kHz with an induction coil, which encloses the discharge sleeve and is arranged in essence coaxially thereto, where, however, at first only the electrically conductive insert absorbs the induction energy and is thereby heated, thus transferring the generated heat though thermal conduction to the actual discharge sleeve made of the refractory material.

Such a discharge sleeve involves, however, only the use of a separate, electrically conductive insert with variable thickness and variable length in proportion to the discharge sleeve, so that the heat buildup varies widely. In addition, the refractory material is not heated through induction, but only through the conduction of heat from the electrically conductive insert. Therefore, with fast heating thermally induced cracks in the refractory material will be generated.

SUMMARY OF THE INVENTION

The object of the present invention is to provide a process of the aforementioned type, applied in general to molded ceramic material, but which avoids the use of specific electrically conductive inserts, and which employs a different chemical composition than that of the actual shaped part, and where a uniform heating is achieved in virtually all parts of the shaped ceramic material.

This object is achieved by the process according to the invention, which is characterized by using a shaped part, which at ambient temperature has a homogeneously distributed carbon skeleton enabling the coupling of the shaped part to a source of induction energy.

DETAILED DESCRIPTION OF THE INVENTION

That is, the present invention provides a process for heating a ceramic shaped part, which comprises providing a ceramic shaped part which at ambient temperature has a homogeneously distributed carbon skeleton, and heating the shaped part inductively.

Shaped ceramic materials, i.e. shaped parts, in particular for metallurgical vessels, such as discharge sleeves, plugs, spouts, immersion nozzles and slide valve plates made of refractory material, are well known refractory bodies in this field of specialization. While in use, they are subjected to high thermal and mechanical stresses.

Thus, e.g., discharge sleeves or immersion nozzles are heated to the melting temperature of the metal flowing through them during their application, and, on the other hand, the surfaces that make contact with the liquid metal are severely eroded by the molten metal flowing through at a relatively high speed. Furthermore, it is mandatory to heat such discharge sleeves to a sufficiently high temperature before contacting the liquid metal, so that they do not crack as a consequence of thermal shock and so that during casting the metal does not solidify due to cooling on the non-heated surfaces of the casting sleeve and thus cause a complete blocking of the passage opening or a significant reduction of the cross section of the passage opening of the discharge sleeve. According to the normally applied state of the art, an immersion nozzle, for example, is heated, therefore, with a gas flame prior to its use. Such a heating takes, however, over a long period of time, e.g. up to 30 minutes and, when there is trouble with the casting, even longer, so that a burn-out of the protective glaze must be taken into account.

It has now been found surprisingly that an inductive uniform heating is possible even for discharge sleeves without an electrically conductive insert as in U.S. Pat. No. 3,435,992, when they are made of a homogeneous refractory material, provided the discharge sleeves have a homogeneously distributed carbon skeleton, thus enabling an inductive coupling to an induction coil, which is attached in a suitable manner and which is driven at a suitable frequency. Also, this applies in general to other ceramic shaped parts, in particular refractory shaped parts, provided they too exhibit a homogeneously distributed carbon skeleton enabling an inductive coupling.

To design such a carbon skeleton it is preferable if the starting mixture contains 2 to 75% by weight, advantageously 3 to 70% by weight, of an organic binder or other additive which yields a carbon skeleton in the shaped part during carbonization.

The inductors used in the process of the invention are well-known. They comprise usually a copper pipe, which is wound in the shape of a coil and through which water flows internally for cooling, and which is driven usually with alternating current of a frequency ranging from 0.1 to 3000 kHz, advantageously at a frequency ranging from 1 to 20 kHz, preferably at a frequency ranging from 2 to 15 kHz. However, frequencies exceeding 100 kHz have also proven themselves effective with thin wall thicknesses or thin coupling layers or porous conductive material.

For the process of the invention, shaped parts made in the usual manner can be used, in particular discharge sleeves or immersion nozzles, which contain as the refractory materials normally aluminum oxide or silicon dioxide or zirconium dioxide or magnesium oxide or optionally also a mixture of two or more of these refractory oxides, and furthermore also contain usually up to 30% by weight of graphite, in particular floc graphite, based on the total composition of the refractory oxides and graphite.

If such shaped parts, e.g. immersion nozzles, are made using binders which, when heated to higher temperatures, advantageously ranging from 400° to 1000° C. and especially preferred from 750° to 850° C., form a carbon skeleton, the result is sufficiently good inductive coupling with sufficiently fast heating during service of the induction coil. The coil must, of course, be designed in such a manner that it yields adequate power.

An especially good inductive coupling is obtained if a shaped part is used for whose manufacture a graphite containing starting mixture is used, where, of course, the aforementioned carbon skeleton must be formed in the shaped part. Experiments have proven that an inductive coupling is not possible even where the shaped part contains graphite, e.g. up to 40% by wt. of graphite, but exhibits no carbon skeleton.

The carbon skeleton in the shaped parts used according to the invention can be formed, for example, by carbonization of synthetic resins, tar or pitch or a mixture thereof, i.e. a binder that can be added during the manufacture of the shaped parts. The carbon skeleton can also be formed by carbonization of derivatives or modifications of synthetic resins, tar and/or pitch. With the use of phenolic resin as the binder, a hardening catalyst, e.g., hexamethylenetetramine, is also usually added.

It is especially advantageous if the carbon skeleton is prepared through carbonization of a binder, which is made from novolak, using hexamethylenetetramine as the hardening agent. Especially good results have been obtained, if, in addition to novolak and the hexamethylenetetramine, furfurylaldehyde is also used in the binder mixture.

Such shaped parts are made by mixing the refractory starting materials, optionally graphite, and binder or other additive which is to form a carbon skeleton; the binder is optionally hardened at temperatures between 120° C. and 200° C., with or without a preceding drying operation, if during the preparation of the starting mixture for the shaped parts water is present in significant quantities; subsequently the shaped parts are heated at suitable temperatures for carbonization, advantageously at temperatures between 400° C. and 1000° C., preferably between 750° C. and 1000° C.

During the manufacture of shaped parts, and in particular immersion nozzles, 2 to 6 parts by weight of resin, in particular one or more phenolic resins like novolaks, based on 100 parts by weight of the remaining solids, are usually added, where the phenolic resins can be added with up to 10% by weight of a hardener such as hexamethylenetetramine, provided they are added in the solid state as a powder, as usual in the prior art. The maximum grain size of the refractory oxides used usually is 1 mm.

The manufacture of the immersion nozzle is described with an example in the following.

75 parts by weight of $Al_2O_3$ with a maximum grain size of 1 mm, 20 parts by weight of $SiO_2$ with a maximum grain size of 0.5mm, and 15 parts by weight of floc graphite with a maximum grain size of 0.3 mm were pelletized together with 4 parts by weight of a powder mixture comprising 90% of novolak resin and 10% of hexamethylenetetramine and addition of 2 parts by weight of furfural in a mixer; and, from this, immersion nozzles with the dimensions: length=800 mm, inner diameter=40 mm and outer diameter=125 mm were shaped in a press. Following drying and hardening at 180° C. the shaped bodies were heat treated or heated in a reducing atmosphere for 5 hours at 800° C., whereby the hardened resin carbonized.

This immersion nozzle could be heated without any problems in a suitably dimensioned and adequately powerful induction coil. In the present case a part of this immersion nozzle with a length of 300 mm was heated to white heat within 3 to 4 minutes; the power consumption corresponded to 30 kW, measured as the power consumption of the induction coil. The frequency was 10 kHz.

The process of the invention is suitable in particular for heating sleeves, such as discharge sleeves, immersion nozzles or shadow pipes prior to bringing them into contact with the liquid metal.

Furthermore, the heating process according to the invention can also be applied to the firing of shaped parts, in particular refractory shaped parts, which are used while casting metals, e.g. for the ceramic inserts of so-called slide valve plates, or also for any arbitrary thermal treatment of shaped parts.

Preferably, the ceramic shaped part exhibits a power conversion of 5 to 15 kW per $dm^3$ of the shaped product, more preferably about 10 kW per $dm^3$.

The process according to the invention is especially advantageous both for firing a shaped part and especially for heating "in time" in the steelwork, if a refractory material is used that exhibits good permeability, so that a noteworthy power conversion can be obtained. Thus, a tubular refractory part with a power consumption of about 10 $kW/dm^3$ in about 2 to 5 minutes can be heated to a red heat. During the fabrication of the fired shaped parts, e.g. such slide valve plates, it can be advantageous not to conduct the heating of the shaped part starting from ambient temperature to firing temperature, but rather following the formation of a carbon skeleton from a suitable organic binder through carbonization at temperatures ranging, e.g., from 550° C. to 800° C., the shaped part that is still at formation temperature or slightly below formation temperature of the carbon skeleton can be inserted directly into a suitably dimensioned induction coil and can be heated up to the firing temperature of the shaped part, for example from a formation temperature of the carbon skeleton of 750° C. to a firing temperature of 1400° C.

This method of further heating, directly after the formation of the carbon skeleton in the shaped part, in an inductor can also be applied to any arbitrary other thermal treatment of the shaped part.

According to another variation, the process of the invention can also be used to heat a green preform, i.e. a shaped part that does not yet contain a carbonized binder. To form the carbon skeleton from the binder contained in the green preform, the green preform is first heated inductively using a jacket, which envelops the shaped part and is coupled inductively at room temperature and which is usually made of metal, e.g. iron, or carbon fibers. However, the jacket can also include molybdenum disilicide or recrystallized SiC as the material enabling the inductive coupling. Such a jacket can be heated inductively and then dissipates through convection and/or radiation its heat to the opposing surface of the green preform, so that at least in this surface region, i.e. outer region of the shaped part, the binder can be carbonized into a carbon skeleton with sufficient thickness of at least several millimeters for coupling. As soon as a carbon skeleton adequate for coupling is formed, the jacket can be removed and the shaped part is further heated inductively, so that a complete heating of the shaped part up to the desired temperature can be effected.

Advantageously this variation of the process of the invention is conducted in one and the same inductor, to which end the jacket must be removed only out of the inductor following suitable heating and then the shaped part is further heated. If the jacket is made of a layer of graphite or carbon or mixture thereof applied with sufficient thickness on the shaped part, the jacket can be simply burned off in an oxidizing atmosphere.

We claim:

1. A process for heating a ceramic shaped part, which comprises providing a ceramic shaped part which exhibits a power conversion of 5 to 15 kW per $dm^3$ of said shaped part and which at ambient temperature has a homogeneously distributed carbon skeleton, and heating said shaped part inductively, beginning at the ambient temperature, at a frequency of 2 to 15 kHz or at a frequency greater than 100 kHz, wherein said carbon skeleton is formed in said shaped part by providing a ceramic shaped part containing a carbonizable material selected from the group consisting of a synthetic resin, pitch, tar, a carbonizable derivative of said resin, pitch or tar, and a mixture thereof, and carbonizing said carbonizable material at 400° to 1000° C. and said shaped part is a wearable steelmaking apparatus component selected from the group consisting of a plug, a sleeve, an immersion nozzle and a slide valve plate for contacting liquid metal.

2. The process according to claim 1, wherein said shaped part is made from a starting mixture comprising 2 to 75% by weight of a material which yields said carbon skeleton.

3. The process according to claim 2, wherein said starting mixture comprises 3 to 70% by weight of said material which yields said carbon skeleton.

4. The process according to claim 1, wherein said carbonizable material is a phenolic resin or a mixture of phenolic resins.

5. The process according to claim 1, wherein said ceramic shaped part contains a ceramic material selected from the group consisting of aluminum oxide, magnesium oxide, silicon oxide, zirconium oxide and a mixture thereof.

6. The process according to claim 1, wherein said shaped part is made from a starting mixture comprising refractory oxides and up to 30% by weight of graphite based on the total weight of the refractory oxides and graphite.

7. The process according to claim 1, wherein said power conversion is about 10 kW per $dm^3$.

8. The process according to claim 1, wherein said heating of said shaped part is effected on location in a steelwork prior to bringing said shaped part into contact with liquid metal for steelmaking.

9. The process according to claim 1, wherein said heating is effected to fire said shaped part.

10. The process according to claim 1, wherein said carbon skeleton is formed in said shaped part by providing a green preform for the shaped part containing a carbonizable material and enveloped by a jacket for inductive heating from room temperature, heating said jacket inductively, thereby heating said green preform by convection or radiation or both at least in an outer region of said preform to carbonize said carbonizable material and form said carbon skeleton in said outer region, removing said jacket from said preform, and further heating said preform inductively to completely form said carbon skeleton.

11. The process according to claim 10, wherein said jacket and said preform are heated inductively in succession by the same inductor.

12. The process according to claim 10, wherein said jacket is constructed of a material selected from the group consisting of metal and carbon fibers.

13. The process according to claim 10, wherein said jacket contains a member selected from the group consisting of molybdenum disilicide and recrystallized silicon carbide.

14. The process according to claim 10, wherein said jacket is a layer containing a member selected from the group consisting of graphite, carbon and a mixture thereof on said preform, and after said carbon skeleton is formed in said outer region of said preform said layer is fired and burned off said preform in an oxidizing atmosphere.

* * * * *